US006555960B1

(12) United States Patent
Kishi et al.

(10) Patent No.: US 6,555,960 B1
(45) Date of Patent: Apr. 29, 2003

(54) FLAT DISPLAY PANEL

(75) Inventors: Hisatoshi Kishi, Tokyo (JP); Kazuhisa Hemmi, Tokyo (JP); Hironobu Arimoto, Tokyo (JP); Atsushi Ito, Tokyo (JP)

(73) Assignee: Mitsubishi Denki Kabushi Kaisha, Tokyo (JP)

( * ) Notice: Subject to any disclaimer, the term of this patent is extended or adjusted under 35 U.S.C. 154(b) by 0 days.

(21) Appl. No.: 09/260,497

(22) Filed: Mar. 2, 1999

(30) Foreign Application Priority Data

Sep. 29, 1998 (JP) ..... 10-275364

(51) Int. Cl.[7] ..... H01J 17/49
(52) U.S. Cl. ..... 313/582; 313/583; 313/631
(58) Field of Search ..... 313/491, 492, 313/631, 583, 586, 582; 345/60–68, 204

(56) References Cited

U.S. PATENT DOCUMENTS

| | | | | |
|---|---|---|---|---|
| 3,662,214 A | | 5/1972 | Lustig | |
| 3,781,599 A | * | 12/1973 | Bonn | 315/169 TV |
| 3,868,676 A | * | 2/1975 | Hennessey et al. | 313/318.01 |
| 4,047,066 A | * | 9/1977 | Kobayakawa et al. | 313/307 |
| 5,446,344 A | * | 8/1995 | Kanazawa | 315/169.4 |
| 5,578,903 A | * | 11/1996 | Pepi | 313/495 |
| 5,656,893 A | * | 8/1997 | Shino et al. | 313/582 |
| 5,674,553 A | * | 10/1997 | Shinoda et al. | 427/157 |
| 6,208,084 B1 | * | 3/2001 | Urakabe et al. | 315/169.4 |
| 6,323,596 B1 | * | 11/2001 | Ito et al. | 315/169.3 |

FOREIGN PATENT DOCUMENTS

| | | |
|---|---|---|
| EP | 0782167 | 7/1997 |
| EP | 0908919 | 4/1999 |
| JP | 2090192 | 3/1990 |
| JP | 394751 | 9/1991 |
| JP | 4149926 | 5/1992 |
| JP | 4245141 | 9/1992 |
| JP | 6251716 | 9/1994 |
| JP | 6275201 | 9/1994 |
| WO | 9844531 | 10/1998 |

* cited by examiner

*Primary Examiner*—Ashok Patel
*Assistant Examiner*—Glenn Zimmerman
(74) *Attorney, Agent, or Firm*—Rothwell, Figg, Ernst & Manbeck

(57) ABSTRACT

In a cell drive-type flat display panel, a metal electrode pad 26 and common signal line 24 are disposed outside the area (effective area) facing a recessed portion forming a cell. The individual cell electrode 20 acting as a cell electrode within the effective area is connected to a metal electrode pad 26 by extending each cell electrode to the metal electrode pad 26, while the metal electrode is not extended toward the effective area to cover each cell electrode. A common electrode 22 is connected to the common signal line 24 by extending each cell electrode to the metal electrode pad 26, while the metal electrode is not extended toward the effective area and to cover each cell electrode. This structure makes the cell electrodes flat and can reduce the drive voltage from the effect resulting from the suppressed dielectric film. The metal electrode pad 26 has a top surface on which a pin electrode is posted. The dielectric layer has an opening from which the metal electrode pad 26 is exposed, and covers the edges of the metal electrode pad 26. This structure can prevent the transparent electrode layer bridging the individual electrode 20 with the metal electrode pad 26 from making contact with the dielectric layer or frit with high reactivity.

8 Claims, 5 Drawing Sheets

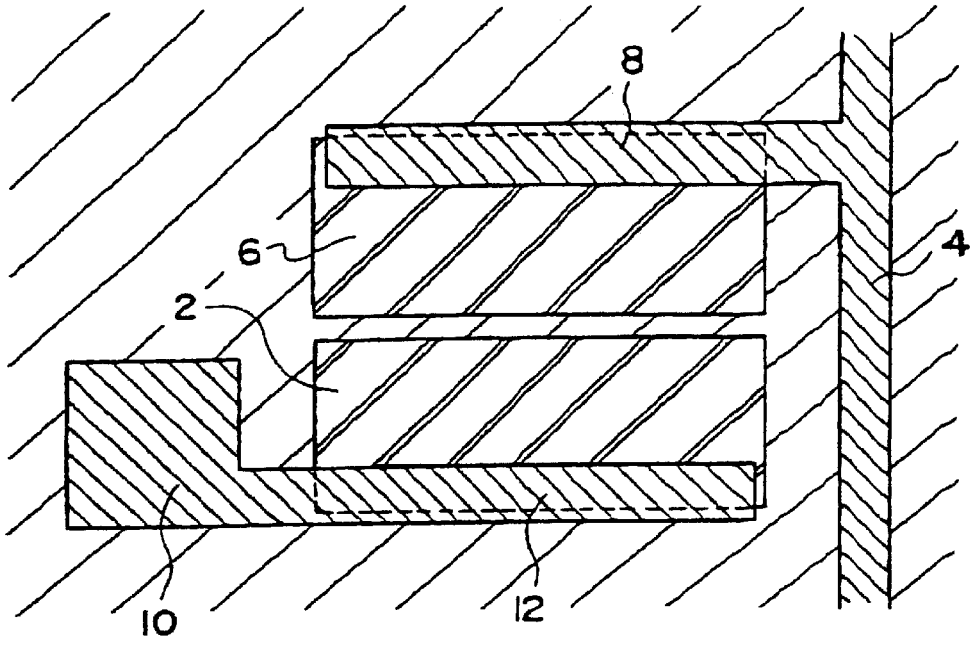
FIG. 1 *PRIOR ART*
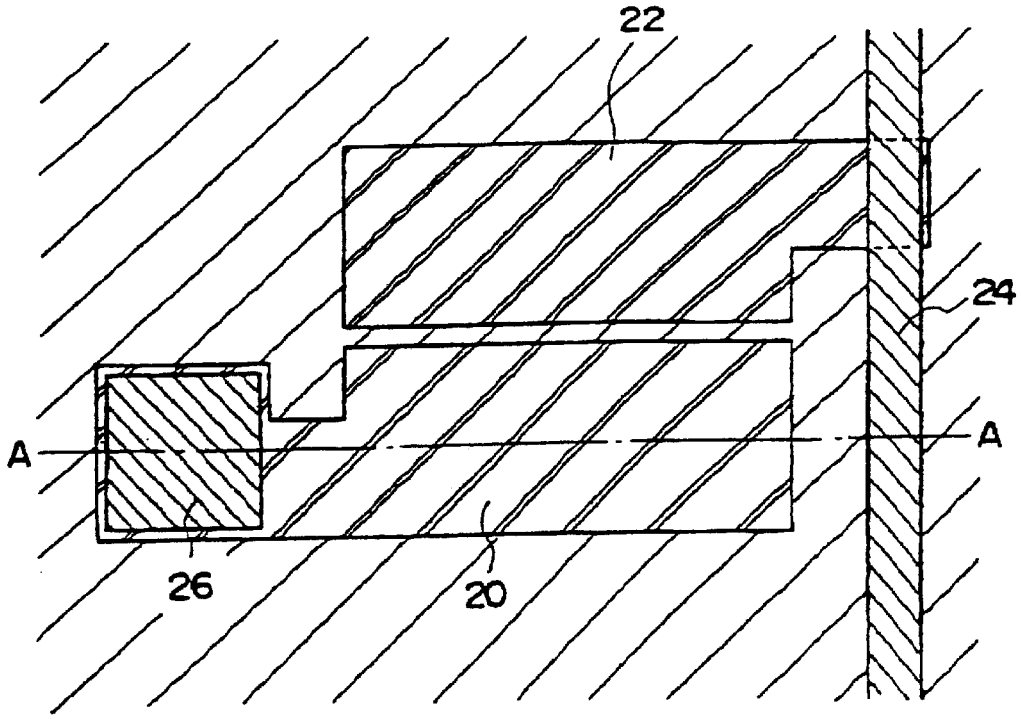
FIG. 2

FLAT DISPLAY PANEL

BACKGROUND OF THE INVENTION

1. Field of the Invention

The present invention relates to a flat display panel, being a flat display device that displays characters, graphics and images using light emission produced by ionized gas, and particularly to an electrode structure which produces a glow discharge.

2. Description of the Related Art

Conventional flat display panels use plasma display panels. This type of display panel is disclosed in, for example, Japanese Patent Laid-open Publication No. Hei 2-90192 (Mar. 29, 1990) and Japanese Utility Model Application Laid-open Publication No. Hei 3-94751(Sep. 26, 1991). In that structure, two substrates, each having a plurality of linear electrodes formed thereon are arranged in parallel so as to face each other. The linear electrodes formed on one substrate and the linear electrodes formed on the other substrate are disposed in a matrix form. Gas discharges occur at intersections between the linear electrodes on one substrate and the linear electrodes on the other substrate.

In such a conventional flat display panel, voltages are applied to the ends of the linear electrodes lead out of the side end surfaces of the plate. The electrodes arranged on the front plate are formed of a transparent electrode material such as ITO through which the emitted light produced by gas discharge can pass. However, The transparent electrode material has a considerably large resistance value because of its low electric conductivity and because the linear electrodes are narrowed and elongated to realize larger-sized, higher-resolution screens. This causes a problem that, as a voltage pulse applied to an end of a linear electrode propagates toward the middle portion of the linear electrode, it is attenuated. To alleviate the problem, attempts have been to improve electric conductivity by partially laminating a thin metal electrode on the transparent electrode. However, this approach is limited in its ability to be applied to conventional flat display panels.

Moreover, in conventional flat display panels, two transparent insulation substrates are arranged so as to face each other and to define glow discharge spaces between them. Partition walls define the discharge space for each display cell. The display operation is performed by selectively controlling confront electrodes arranged in a matrix form. Hence, display cells cannot be independently controlled and, the thickness of the display panel structure becomes large, which are two serious problems.

DESCRIPTION OF THE RELATED ART

Because of the limitations described above, a flat display panel with a novel structure different has been strongly desired. The present applicant proposed a flat display panel with a new structure in international application (PCT/JP98/01444) based on the Patent Cooperation Treaty. The flat display panel described in that publication includes a back substrate on which plural recessed portions each acting as a glow discharge space are arranged, and a transparent front substrate facing the back substrate and comprising areas (effective areas) respectively facing the recessed portions, each area having a pair of cell electrodes. In the flat display panel, pin electrodes penetrate the back plate so that a voltage signal can be applied to a given spot of an electrode formed on the front plate. That is, this structure allows a voltage to be applied between a pair of cell electrodes corresponding to a display cell so that the display cells can be respectively display-controlled by applying respective voltages. Because the back plate has recessed portions each for a discharge space, it is not necessary to form partition walls partitioning discharge spaces on the substrate, as were required in the previous art. Hence, this feature enables the manufacture of thinner display panels.

The basic structure of a flat display panel with the above-mentioned structure has been proposed. However, further improvement of the flat display structure is possible.

For example, in a typical conventional flat display panel, a metal electrode is laminated on a transparent electrode to reduce the resistance of the transparent electrode. Since this structure increases the unevenness of the surface on which electrodes are formed, the thin dielectric layer suitable to a low voltage drive operation tends to easily cause an electrical breakdown thereof. Thickening the dielectric layer in order to avoid such a problem results in an increase in the drive voltage.

To secure a stable glow discharge, the dielectric layer must be formed to have flat top surfaces. However, dielectric material which provides superior flatness is also prone to causing broken conductor because of the chemical reaction with the transparent electrode. For that reason, conventionally, a material with poor flatness but with low chemical reaction between the transparent electrode and the metal electrode is used. These problems remain in flat display panels with the above-mentioned new structure.

SUMMARY OF THE INVENTION

The present invention is made to solve the above-described problems in conventional flat display panels. It is an object of the present invention to provide a novel flat display panel that can decrease the drive voltage by suppressing the thickness of the dielectric film and can realize a stable glow discharge by suppressing deterioration of the cell electrode.

According to the present invention, the flat display panel comprises a back substrate in which plural recessed portions each acting as a discharge space are arranged; a transparent front substrate disposed so as to face the back substrate, and having effective regions respectively facing the recessed portions, and each including a pair of cell electrodes; pin electrodes penetrating the back substrate and erecting on the surface of the front substrate, each of the pin electrodes supplying a voltage to a cell electrode; and metal electrodes respectively disposed adjacent to the effective regions on the front substrate and respectively connected to the pin electrodes; wherein each of the cell electrodes is formed in a flat state using a transparent electrode layer, the cell electrodes extending near to the effective regions, the cell electrodes being respectively connected to the metal electrodes.

In a flat display panel according to the present invention, at least one of the pair of cell electrodes may be an individual electrode separated every display cell. The metal electrodes are respectively disposed to the individual electrodes, each of the metal electrodes having a pin electrode planted thereon.

According to the present invention, the flat display panel may further comprise a dielectric layer covering the transparent electrode layer, the dielectric layer having an opening at a portion where a pin electrode is planted on the metal electrode is planted, and edge portions of the dielectric layer defining the opening being positioned on the metal electrode.

BRIEF DESCRIPTION OF THE DRAWINGS

This and other objects, features and advantages of the present invention will become more apparent upon a reading of the following detailed description and drawings, in which:

FIG. 1 is a plan view schematically illustrating the structure of a cell electrode of a flat display panel of the present applicant;

FIG. 2 is a plan view schematically illustrating the structure of an example cell electrode of a flat display panel according to a first embodiment of the present invention;

DESCRIPTION OF THE PREFERRED EMBODIMENTS

Figure 3:
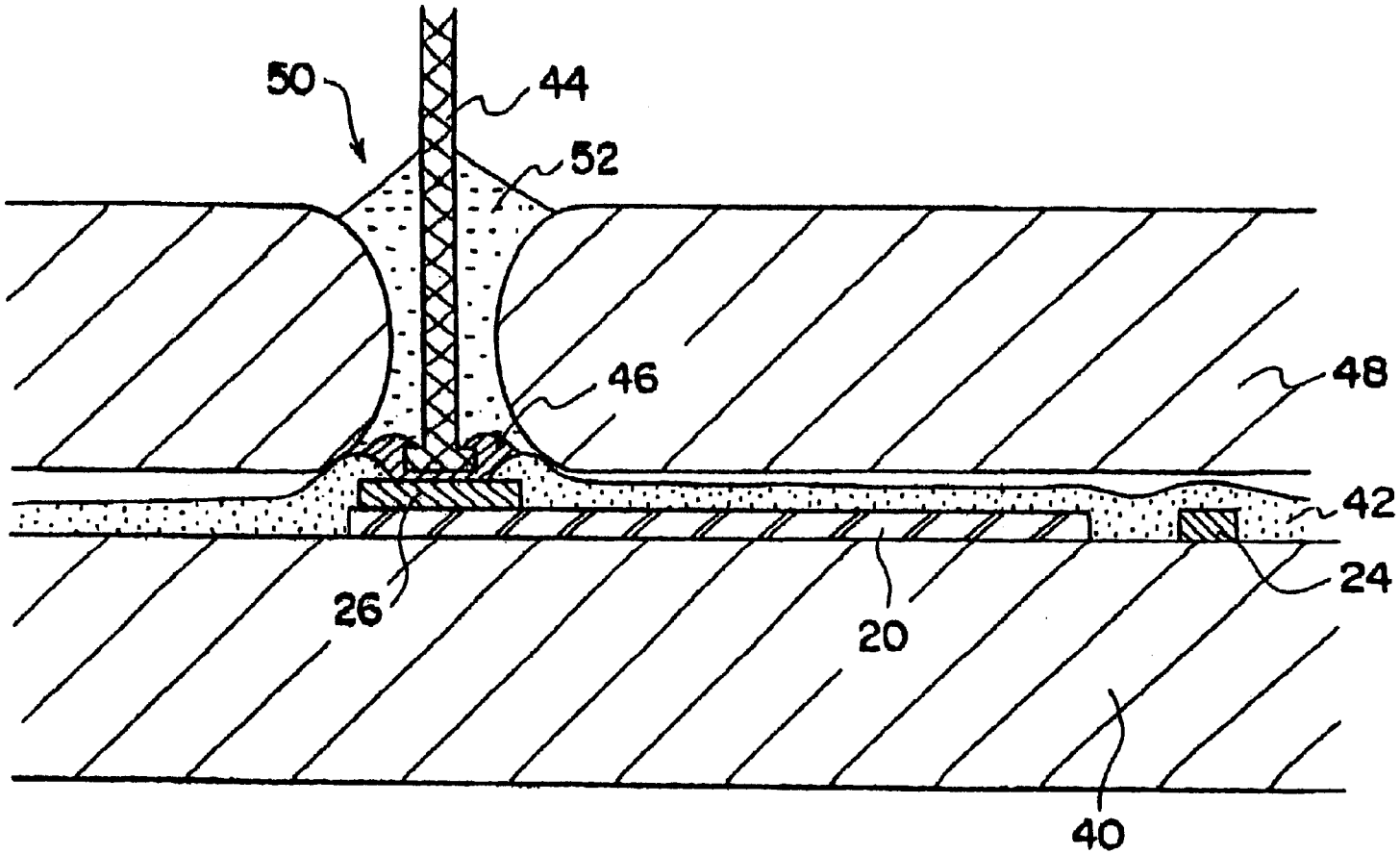
FIG. 3 is a cross-sectional view schematically illustrating the structure of the cell electrode of a flat display panel in a complete state, taken along the line A—A of FIG. 2.
Figure 4A:
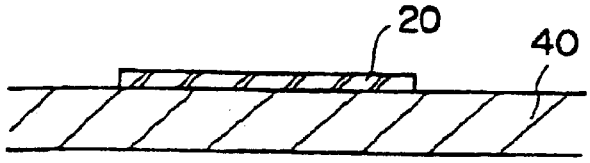
FIG. 4 is a flowchart schematically and chronologically illustrating the main steps in the front panel producing process according to the present invention.
Figure 4B:
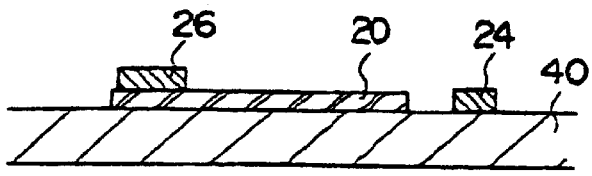
Figure 4C:
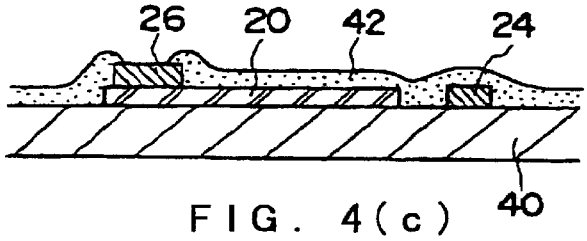
Figure 4D:
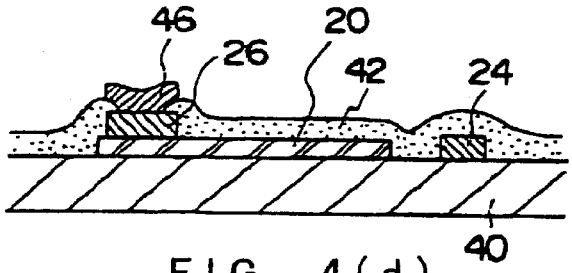
Figure 4E:
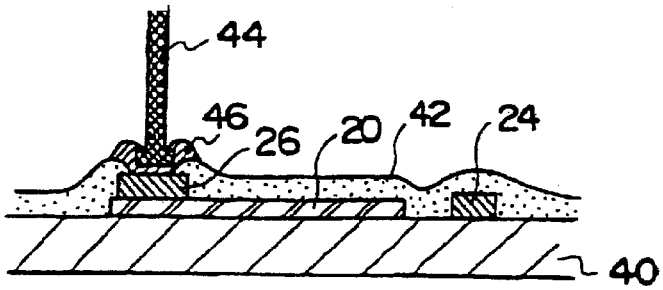

Next, a preferred embodiment of the present invention will be described below with reference to the attached drawings.

FIG. 1 is a schematic diagram illustrating a cell electrode portion of the flat display panel with the new structure previously proposed by the present applicant. This structure imitates the electrode structure of the conventional flat display panel and has metal electrodes respectively formed on cell electrodes each being a transparent electrode. FIG. 1 shows the configuration of a pair of cell electrodes. The cell electrode pair includes a individually driven electrode 2 being a transparent electrode connected to a pin electrode and a common electrode 6 being a transparent electrode connected to a common signal line 4, which are disposed on the front substrate being a transparent glass substrate. The individual electrode 2 and the common electrode 6, each of rectangular form, are disposed in parallel to each other and face the recessed portion defining a cell in the back substrate. The individual electrode 2 and the common electrode 6 are both formed of a transparent material such as ITO of a thickness of about 1000 Å.

The common signal line 4 is formed of a metal, preferably, silver (Ag). The common signal line 4 is connected to the common electrode 6 with an elongated metal electrode 8 extending from the common signal line 4. The metal electrode line 8 extends from one short side to the other short side along the long side of the common electrode 6.

The individual electrode 2 is connected to the metal electrode pad 10 disposed at a location where a pin electrode is planted, with the elongated metal line 12. Like the metal electrode line 8, the metal electrode line 12 extends from one short side to the other short side along the long side of the discrete electrode 2. In this case, the common signal line 4, the metal electrode line 8 and the metal electrode pad 10 and the metal electrode line 12 are formed on the same layer and have, for example, a width of 5 to 10 $\mu$m, respectively.

As described above, the originally proposed structure includes the metal electrode line 8 laminated substantially over the entire long side of the transparent electrode 6, as well as the metal electrode line 12 laminated substantially over the entire long side of the transparent electrode 2. This structure imitates the structure employed in conventional flat display panels. That is, this structure is designed such that a metal electrode acting as an auxiliary electrode formed on the transparent electrode with a lower conductivity than the metal suppresses a voltage drop due to the transparent electrode, thus providing a uniform voltage distribution within the electrode.

However, this structure also has the same problem as that in the above-mentioned conventional flat display panel. As each of the metal electrode lines 8 and 12 are relatively thick, large steps are formed on the transparent electrodes. Consequently the dielectric layer tends to be thinned on the metal electrode line 8, 12. For this reason, in order to secure a sufficient electrical insulation quality, the dielectric layer must be thickened over the entire area. However, this creates a problem in that the thicker layer causes the drive voltage to increase. In order to avoid that the opaque metal electrode line running over the center portion of the cell effective region, the metal electrode lines 8 and 12 are largely spaced apart. Moreover, the metal electrode portions, each on which the dielectric layer tends to decrease its electrical insulation characteristic, are separated from each other so that the field strength at the area adjacent to the metal electrode lines is suppressed. This structure can alleviate, but not solve, the above-described problems.

The present invention, as described below, is made to fundamentally solve the problems recognized at the prototyping stage. One feature of the flat display panel according to the present invention is that pin electrodes are planted through the back substrate to supply a voltage signal to a given portion of the front substrate. A voltage signal is supplied to the individual electrode through the pin electrode.

For example, as another voltage signal supplying method, metal wiring conductors extending from the panel end portion to individual electrodes are disposed on the substrate may be used. With such a structure, a plurality of wiring conductors corresponding to the number of cells are disposed in the limited space between cells. Hence, since the width of each line becomes very narrow, even the voltage drop across the metal conductor cannot be ignored. Moreover, since conductors are arranged in parallel in the narrow area, crosstalk of pulse signals may occur between individual electrodes.

In contrast, the method of supplying voltage signals through the pin electrodes in the present configuration eliminates the above-mentioned problem. Particularly, even cells positioned in the inner area of the flat display panel can receive a pulse signal, the voltage drop of which can be ignored.

FIG. 2 is a schematic diagram illustrating the cell electrode structure according to an embodiment of the present invention. The cell electrode structure includes an individual electrode 20, a common electrode 22, a common signal line 24, and a metal electrode pad 26. This differs from the structure shown in FIG. 1 in that the metal electrode line does not extend from the metal electrode pad 26 to the individual electrode 20 and from the common signal line 24 to the common electrode 22. That is, the individual electrode 20 and the common electrode 22 each formed of a transparent electrode layer are disposed in the effective area confronting the cell recessed portion. The individual electrode 20 is elongated to make an electrical contact with the metal electrode pad 26 arranged close to the effective area while the common electrode signal line 22 is elongated to make an electrical contact with the common signal line 24. In the fabrication step, the transparent electrode layer is first formed and then the metal electrode layers are formed. In concrete, the individual electrode 20 is patterned so as to include the area where the metal electrode pad 26 is formed. The common electrode 22 is patterned so as to extend to the common signal line 24. The metal electrode pad 26 is formed over a portion of the individual electrode 20 whereas the common signal line 24 crosses over the common electrode 22.

The long side of the individual electrode may measure about 1 cm, being shorter than that of the conventional linear transparent electrodes. The short side of the individual electrode may measure about several millimeters, being wider than that of conventional linear transparent electrodes. Compared with the electrode structure in the conventional flat display panel, the above-mentioned electrode structure allows the voltage drop between the metal electrode pad 26 and the opposite end of the individual electrode 20 or the voltage drop between the common signal line 24 and the common electrode 22 to be reduced to a negligible value. The use of the pin electrode allows the voltage pulse propagated from the individual electrode 20 to the metal electrode pad 26 to be substantially attenuated. On the other hand, although -the common signal line 24 is disposed on the limited space between cells, it can be distributed in common to each cell forming a row or column. Hence, the common signal line can have a relatively large width in a limited space and, as it is formed of a metal, the resulting voltage drop is small.

In other words, since the present flat display panel has a structure which does not substantially deteriorate the voltage signal supplied to the individual electrode 20 or the common electrode 22, it is not necessary that the metal electrode line be elongated toward the inner portion of the individual electrode 20 or the common electrode 22 to suppress the voltage drop. The metal electrode line within the effective area of a cell can be removed as shown in FIG. 2. Instead, both the individual electrode 20 and the common electrode 22 in the effective area facing the cell in which a glow discharge occurs are formed of only a transparent electrode layer and in a flat state.

Both the individual electrode 20 and the common electrode 22 formed in a flat state can make the thickness of dielectric layer uniform and can decrease the dielectric thickness without inducing the field breakdown, thus resulting in a low drive voltage.

As shown in FIG. 2, the width of the bridge portion between the effective area of the individual electrode 20 and the metal electrode pad 26 is set to a wider value than that of the metal electrode line 12 shown in FIG. 1. The width of the bridge portion between the effective area of the common electrode 22 and the common signal line 24 is set to a wider value than that of the metal electrode line 8. This design choice enables the electrical resistance of the portions to be reduced. In the individual electrode 20 and the common electrode 22, the width of the bridge portion is set to a value very close to the width of the short side of each electrode, within a range where the discharge and other characteristics are not adversely affected.

FIG. 3 is a cross sectional view schematically illustrating the flat display panel in a completed state, taken along the line A—A in FIG. 2. A transparent glass substrate 40 is employed for the front panel. An individual electrode 20 of a transparent layer is formed on the back surface (facing the discharge space or represented as the upper side in FIG. 3) of the glass substrate 40. Thereafter, the metal electrode pad 26 and the common signal line 24 are each formed of a metal electrode material. The metal electrode pad 26 is placed on the individual electrode 20, and a dielectric layer 42 is then deposited over the individual electrode 20 and the metal electrode pad 26. In order to plant the pin electrode 44 on the metal electrode pad 26, an opening is formed at the middle portion of the metal electrode pad 26. A silver (Ag) paste layer 46 is coated on the area for erecting the pin electrode 44. One end of the pin electrode 44 is buried in the Ag paste layer 46. Then, the Ag paste layer 46 is calcined. After the pin electrode 44 is securely attached on the metal electrode pad 26, a MgO film (not shown) are vapor-deposited over the entire back surface of the front substrate in a vacuum chamber. Thereafter, as a back substrate, the glass substrate 48 acting with an opening at the position where the pin electrode 44 is erected, is placed over the completed front panel. In order to hermetically seal the two substrates, a low-melting-point glass (such as a fritted glass 52) is poured into the gap between the pin electrode 44 and the opening 50.

The feature of the front panel structure according to the present invention is that the metal electrode pad 26 is formed before formation of the dielectric layer 42 so that the edges of the opening defined by the dielectric layer 42 cover the edges of the metal electrode pad 26. The edges of the dielectric layer 42 are therefore not in direct contact with the transparent electrode film forming the individual electrode 20 and the transparent electrode film is completely covered with the dielectric layer 42.

If the dielectric layer 42 is patterned so as not to cover the edges of the metal electrode pad 26, the edges of the dielectric layer 42 will be in contact with the individual electrode 20 (first state) while part of the individual electrode 20 will be completely covered with the dielectric layer 42 (second state). The first state has the following disadvantages. Like a conventional flat display panel, the dielectric layer 42 is formed of a plurality of layers each formed a different component and may have, for example, a three-layered structure. In the structure described above, the lowest layer being in contact with the transparent electrode provides a relatively low step coverage, but is formed of a dielectric material showing a low reactivity to the transparent electrode. The top layer shows a high reactivity to the transparent electrode, but is formed of a dielectric material providing superior flatness. This structure prevents the transparent electrode from being broken because of the chemical reaction with the top dielectric layer and makes the transparent layer 42 flat. However, when the edges of the dielectric layer 42 with the plurally-layered structure are formed on the transparent electrode, the top dielectric layer with a high reactivity may contact with the transparent electrode so that breakage of transparent electrode may occur.

Moreover, the second state has the following disadvantage. That is, the fritted glass 52 chemically reacts with the exposed portion of the transparent electrode, thus resulting in breakage of the transparent electrode.

According to the present invention, in order to avoid the above-mentioned problems, the edges of dielectric layer 42 are overlapped with the edges of the metal electrode pad 26 so that the breakage of the individual electrode 20 can be prevented.

It should also be noted that the above-mentioned problems are unlikely to occur in the device shown in FIG. 1, because the individual electrode 2 in not in direct contact with the metal electrode pad 10. That is, even if the metal electrode pad 10 is totally exposed such that the edges of the dielectric layer do not partially cover the metal electrode pad 10, the first and second states do not occur if the edges are placed between the metal electrode pad 10 and the individual electrode 2.

Figure 5:
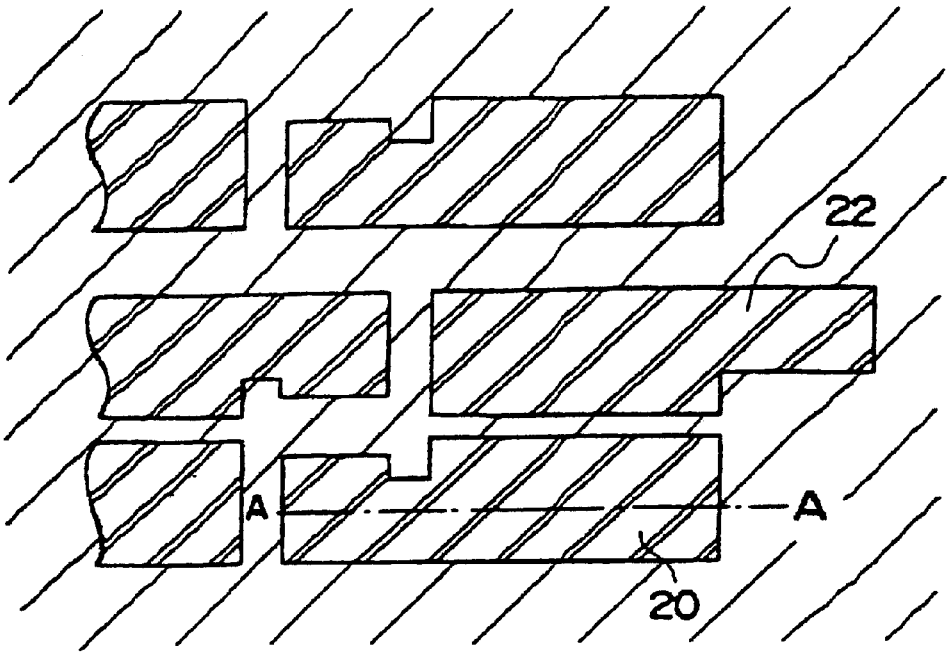
FIG. 5 is a plan view schematically and partially illustrating the front panel after an ITO film patterning step.
Figure 6:
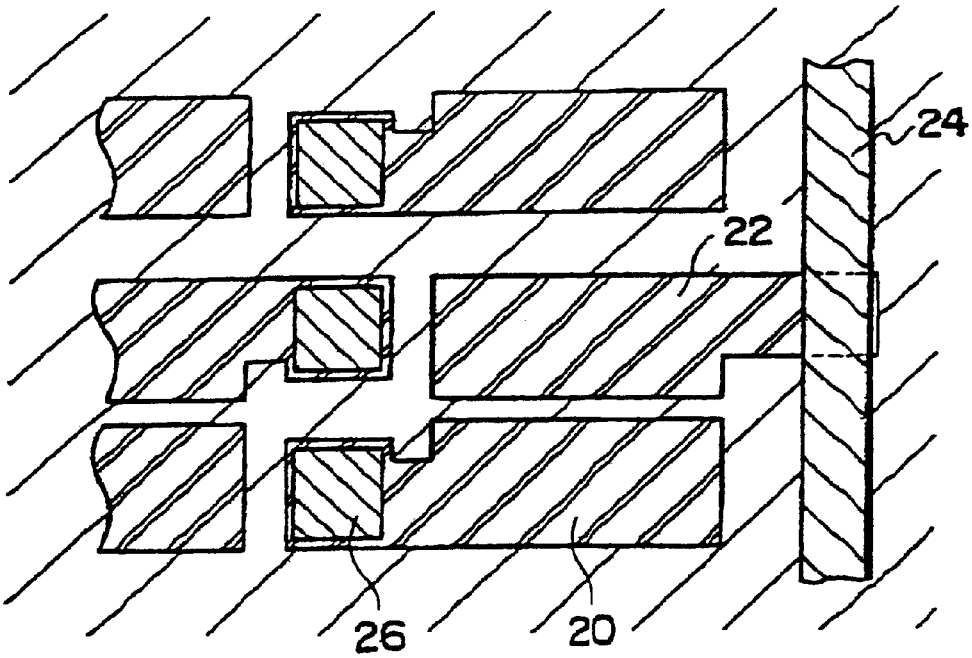
FIG. 6 is a plan view schematically illustrating a portion of the front panel after a first Ag-film electrode layer forming step.
Figure 7:
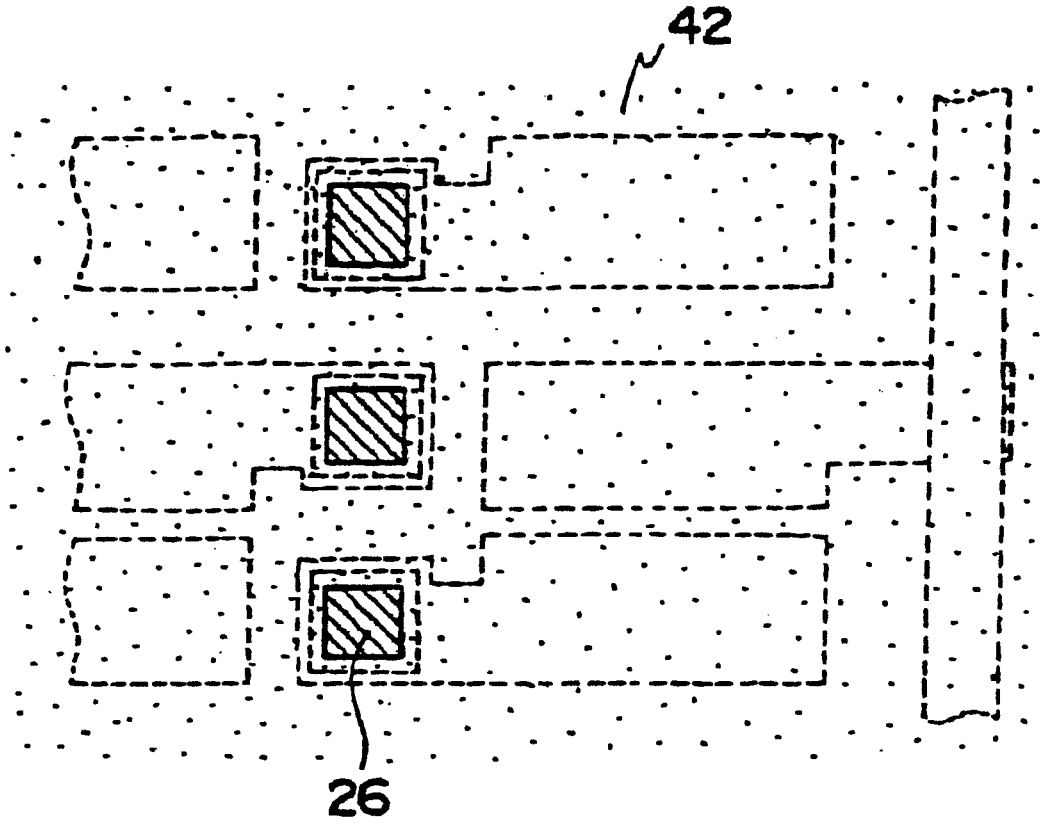
FIG. 7 is a plan view schematically and partially illustrating the front panel after a dielectric film forming step.

Next, the method of fabricating the structure shown in FIG. 3 will be described below. FIG. 4 chronologically illustrates main steps in the flat display fabrication process. FIGS. 5–7 are plan views partially and schematically illustrating the front panel in the typical steps of the flat display panel fabrication process.

A silicon dioxide ($SiO_2$) film (of thickness (t) about 1000 Å) and an ITO film acting as a transparent electrode film (with thickness of about 1000 Å) are sequentially sputtered on the back surface of the glass substrate 40 or the front substrate. A photoresist film is first coated on the ITO film and is then selectively removed in a pattern by performing an exposure step and an etching step to form a photoresist pattern. The ITO film is subjected to a wet-etching step, with the photoresist film pattern acting as a mask. Thus, the individual electrode 20 and the common electrode 22 are formed. FIG. 5 is a plan view partially and schematically illustrating the front panel after the ITO patterning step, while FIG. 4(*a*) is a cross-sectional view schematically illustrating the front panel taken along the line A—A.

Next, a first Ag electrode layer is silk-screened using a paste containing Ag as the main ingredient, and the solvent in the paste is evaporated by heating. Moreover, the paste is calcined to form a metal electrode including the metal electrode pad 26 and the common signal line 24. FIG. 4(*b*) is a cross-sectional view illustrating the front panel after the above-described step. After the calcination step, the thickness of the metal electrode is, for example, 5 to 10 $\mu$m. FIG. 6 is a plan view partially and schematically illustrating the front panel after the first Ag electrode layer forming step.

Next, the dielectric material is silk-screened so as to cover the ITO electrode and is then calcinated to form a dielectric layer 42. The softening temperature of the dielectric material is, for example, about 560° C. FIG. 4(*c*) is a cross-sectional view schematically illustrating the front panel after the calcination step. The dielectric layer 42 has a three-layered structure, as described above. However, FIG. 4(*c*) shows the dielectric layer 42 as a single layer for the purpose of simplification. FIG. 7 is a plan view partially and schematically illustrating the front panel after the step of forming the dielectric layer 42. The edges of the opening formed in the dielectric layer 42 covers the fringe portion of the top surface of the metal electrode pad 26. The transparent electrode portion bridging between the individual electrode 20 and the metal electrode pad 26 is not in contact with the edge of the dielectric layer 42. Since the bridge portion is covered with the dielectric layer 42, and must not contact with the fritted glass in the post step. The total thickness of the dielectric layer 42 in a three-layered structure is about 30 $\mu$m. The dielectric layer 42 is made of a transparent material so that the light produced in the cell may pass through the glass substrate 40.

In the present structure, the first Ag layer is first formed such that the ITO film does not come in contact with the edges of the dielectric layer 42. Because the first Ag layer is in a metalic state at this point, the pin electrode 44 cannot be directly bonded on the metal electrode pad 26. In order to erect the pin electrode 44, a second Ag paste layer is silk-screened onto the erecting area. FIG. 4(*d*) is a cross-sectional view schematically illustrating the front panel after forming the Ag paste layer 46. The second Ag paste layer is coated so as to settle about 5 to 10 $\mu$m after the calcination step.

The pin electrode 44 is erected before the second Ag film is calcined. In the pin erecting step, the ceramic substrate, in which holes matching with pin electrode erecting positions are formed, is prepared. The pin electrodes are then planted into the holes of the ceramic substrate. The side protrusion of the head of the pin electrode 44 anchors itself in the substrate. The front panel is placed over the top surface of the ceramic substrate in which the heads of the pin electrodes are arranged, with the back surface of the front panel down. The heads of the pin electrodes 44 are bonded on the second Ag layer formed in the above step. Thereafter, the structure is turned upside down. The ceramic substrate is then upward pulled out of the front panel, while the pin electrodes are left on the front panel. The pin electrodes are securely fixed on the front panel by calcinating the second Ag layer. FIG. 4(*e*) is a cross-sectional view schematically illustrating the front panel in the above-mentioned step. The ceramic substrate is removed before the calcination step because the linear thermal expansion coefficient of the glass substrate 40 differs from that of the ceramic substrate.

Finally, a MgO film acting as an protective film is evaporated in a vacuum chamber. Although, substances produced out of the dielectric layer 42 deteriorate the fluorescent substance coated on the cell of the back substrate when the lead glass, or the dielectric layer 42, is exposed to a glow discharge and is thus sputtered, the MgO film has a high resistance characteristic against glow discharge and can protect the dielectric film 42 from the glow discharge, thus solving this problem. The MgO also has a high secondary emission coefficient and contributes to a decrease of the discharge starting voltage.

The thus fabricated front panel is combined with the back panel formed using the back substrate. Holes through which pin electrodes penetrate and the gaps between the fringe portions of the two panels are then hermetically frit sealed. The air contained in the two-panel structure is evacuated through the exhaust glass tube attached on the back panel. Next, Ne—Xe (5%), for example, is filled into the two-panel structure and the exhaust glass tube is sealed hermetically. The flat display panel is at this point basically complete.

In the flat display panel according to the present invention, all metal electrodes are not disposed in the effective area, but are generally disposed adjacent to the effective area facing the cell forming recessed portion. The transparent electrode layer formed in the area (effective area) facing the recessed portion extends to the metal electrode to electrically connect with metal electrode. The cell electrode facing the glow discharge space is flattened with the transparent electrode layer. Thus, the dielectric layer is uniformly deposited over the transparent electrode layer. This structure suppresses electrical breakdown of the dielectric layer. Hence, the dielectric layer can be thinned so that the drive voltage is effectively reduced.

In the flat display panel according to the present invention, metal electrodes are respectively disposed together with individual electrodes and pin electrodes are respectively erected on the metal electrodes. Since a voltage is applied through the pin electrode planted on the back substrate, variations in the electrical resistance between the metal electrode and the voltage pulse source for cells can be suppressed. The absolute value of the resistance value between the metal electrode and the voltage pulse source is also suppressed. The effects of the electrical resistance between the edge of the discrete electrode and the voltage pulse source are alleviated and the flat display panel can be effectively driven with a voltage pulse with less attenuation.

In the flat display panel according to the present invention, the edges of the opening in the dielectric layer formed at the pin electrode erecting position are positioned on the metal electrode so that the breakage of the transparent electrode forming the cell electrode can be prevented, while a stable glow discharge can be effectively realized by suppressing deterioration of a cell electrode.

What is claimed is:

1. A flat display panel comprising:

a back substrate having plural recessed portions, said recessed portions acting as discharge spaces;

a transparent front substrate facing said back substrate and having effective regions facing said recessed portions, said effective regions including a pair of cell electrodes;

pin electrodes penetrating said back substrate and extending upwardly from the surface of said front substrate, said pin electrodes supplying a voltage to said cell electrodes; and metal electrodes disposed adjacent to said effective regions and being connected to said pin electrodes;

wherein said cell electrodes are formed in a flat state using a transparent electrode layer, extend substantially near said effective regions, and are connected to said metal electrodes.

2. The flat display panel defined in claim 1, wherein at least one of said pair of cell electrodes is an individual electrode, and said metal electrodes are respectively disposed to said individual electrodes, said metal electrodes having a pin electrode planted thereon.

3. The flat display panel defined in claim 2, further comprising a dielectric layer covering said transparent electrode layer, said dielectric layer having an opening at a portion where a pin electrode is planted on said metal electrode and edge portions defining said opening being positioned on said metal electrode.

4. The flat display panel defined in claim 1, wherein said metal electrode is formed after said transparent electrode has been formed.

5. A flat display panel comprising:

a back substrate having plural recessed portions, said recessed portions acting as discharge spaces;

a transparent front substrate confronting said back substrate and having effective regions confronting said recessed portions, said effective regions including a pair of cell electrodes;

pin electrodes penetrating said back substrate and extending upwardly from said front substrate, said pin electrodes supplying a voltage to said cell electrodes; and metal electrodes disposed in respective non-discharge regions in said front substrate; wherein said cell electrodes are formed in a flat state using a transparent electrode layer, extend to respective non-discharge regions and are connected to said metal electrodes.

6. The flat display panel defined in claim 5, wherein at least one of said pair of cell electrodes is an individual electrode, and said metal electrodes are respectively disposed to said individual electrodes, said metal electrodes having a pin electrode planted thereon.

7. The flat display panel defined in claim 6, further comprising a dielectric layer covering said transparent electrode layer, said dielectric layer having an opening at a portion where a pin electrode is planted on said metal electrode and edge portions defining said opening being positioned on said metal electrode.

8. The flat display panel defined in claim 5, wherein said metal electrode is formed after said transparent electrode has been formed.

* * * * *